US010560995B2

(12) United States Patent
Belin et al.

(10) Patent No.: US 10,560,995 B2
(45) Date of Patent: Feb. 11, 2020

(54) CONFIGURATION OF THE INTENSITY OF THE LIGHT SOURCES COMPOSING A LIGHTING SYSTEM

(71) Applicant: WATTLUX, Strasbourg (FR)

(72) Inventors: Patrick Belin, Strasbourg (FR); Yannick Bailly, Bermont (FR)

(73) Assignee: WATTLUX, Strasbourg (FR)

( * ) Notice: Subject to any disclaimer, the term of this patent is extended or adjusted under 35 U.S.C. 154(b) by 0 days.

(21) Appl. No.: 16/065,811

(22) PCT Filed: Dec. 16, 2016

(86) PCT No.: PCT/FR2016/053499
§ 371 (c)(1),
(2) Date: Jun. 24, 2018

(87) PCT Pub. No.: WO2017/109351
PCT Pub. Date: Jun. 29, 2017

(65) Prior Publication Data

US 2019/0021146 A1 Jan. 17, 2019

(30) Foreign Application Priority Data

Dec. 24, 2015 (FR) ..... 15 63327

(51) Int. Cl.
*H05B 33/08* (2006.01)

(52) U.S. Cl.
CPC ..... *H05B 33/086* (2013.01); *H05B 33/0866* (2013.01)

(58) Field of Classification Search
CPC ..... H05B 33/086; H05B 33/0866
See application file for complete search history.

(56) References Cited

U.S. PATENT DOCUMENTS

| | | | |
|---|---|---|---|
| 6,379,002 | B1 | 4/2002 | Amerson |
| 2008/0215279 | A1 | 9/2008 | Salsbury |
| 2012/0010861 | A1 | 1/2012 | Hu |

FOREIGN PATENT DOCUMENTS

| | | | |
|---|---|---|---|
| EP | 2753150 | A1 | 7/2014 |
| WO | 2017109351 | A1 | 6/2017 |

OTHER PUBLICATIONS

Foreign Correspondence From a Related Counterpart Application, International Search Report and Written Opinion dated Mar. 30, 2017, International Application No. PCT/FR2016/053499 filed on Dec. 16, 2016.

*Primary Examiner* — Douglas W Owens
*Assistant Examiner* — Jianzi Chen

(57) ABSTRACT

The invention relates to a method for configuring a lighting system including a set of at least 3 light sources (Li) having different spectra (Si(λ)), including a step of automatically defining the intensities (φi) of each of the light sources of said set by minimising a distance between a reference spectrum (SR(λ)) and a synthetic spectrum (Ss(λ)) defined by the sum of the spectra (Si(λ)) of each source (Li) of said set weighted by said intensities (φi).

7 Claims, 2 Drawing Sheets

CONFIGURATION OF THE INTENSITY OF THE LIGHT SOURCES COMPOSING A LIGHTING SYSTEM

CROSS-REFERENCE TO RELATED APPLICATIONS

The present application is a filing under 35 U.S.C. 371 as the National Stage of International Application No. PCT/FR2016/053499, filed Dec. 16, 2016, entitled "CONFIGURATION OF THE INTENSITY OF THE LIGHT SOURCES COMPOSING A LIGHTING SYSTEM," which claims priority to French Application No. 1563327 filed with the Intellectual Property Office of France on Dec. 24, 2015 and entitled "CONFIGURATION OF THE INTENSITY OF THE LIGHT SOURCES COMPOSING A LIGHTING SYSTEM," both of which are incorporated herein by reference in their entirety for all purposes.

DOMAIN OF THE INVENTION

The invention relates to a lighting system composed of several different light sources. More particularly, it relates to the configuration of the intensity of each of these sources so as to approach a perceived reference spectrum.

CONTEXT OF THE INVENTION

There are many light sources available on the market. Each is characterised by a light source and a light spectrum, very often modelled by its colour temperature with reference to a black body heated to between 1500 and 10000 K that would provide an emission spectrum in the visible light range similar to that of a light bulb.

These existing sources offer a large choice to users, but the choice is incomplete because there is no guarantee that there is a light source available on the market for a given reference spectrum. Furthermore, these light sources are static and cannot be configured to provide a reference spectrum. A fortiori, it is impossible to take an ambient colorimetric context into account to configure light sources available on the market to obtain the required reference spectrum.

For example, the required reference spectrum could be the solar spectrum. We then define the colour rendering index CRI as being maximum when the human eye considers an object illuminated by sunlight. Light sources can achieve high CRI values, but not using all technologies. Thus, LEDs (Light Emitting Diodes) usually achieve CRI values of the order of 65 for the most widespread, and rarely exceed 85.

Furthermore, if a third light source is present, it is no longer possible to adapt the principal light source to obtain a global spectrum with a sufficiently high CRI.

Consequently, there are many reasons to attempt to improve the situation.

SUMMARY OF THE INVENTION

The purpose of this invention is to provide a method of configuring a lighting system that at least partially mitigates the above-mentioned disadvantages.

To achieve this, this invention discloses a method for configuring a lighting system including a set of at least 3 light sources having different spectra $S_i(\lambda)$, including a step of automatically determining the intensities $\varphi_i$ of each of the light sources of said set by minimising a distance between a reference spectrum $S_R(\lambda)$ and a synthetic spectrum $S_S(\lambda)$ determined by the sum of the spectra $S_i(\lambda)$ of each source of said set weighted by said intensities $\varphi_i$.

Depending on the preferred embodiment, the invention includes one or several of the following characteristics that may be used separately or partly combined with each other or all combined with each other:

- the distance is calculated between a perception $P_{R,j}(\lambda)$ corresponding to said reference spectrum and a perception $P_j(\lambda)$ corresponding to said synthetic spectrum, said perceptions being considered on a set of detectors of a given observer;
- the reference spectrum corresponds to the solar spectrum;
- the given observer is a human eye;
- perceptions are determined by the product of said spectra and sensitivities, $\sigma_j(\lambda)$, associated with each of said detectors.
- perception of the synthetic spectrum is provided by the equation:

$$P_j = \int_0^\infty S_s(\lambda) \cdot \sigma_j(\lambda) \cdot d\lambda$$

and perception of the reference spectrum is provided by the equation:

$$P_{R,j} = \int_0^\infty S_R(\lambda) \cdot \sigma_j(\lambda) \cdot d\lambda$$

in which $\lambda$ represents the wavelength;

said distance is minimised using a least squares method;

the light sources are LEDs;

Another purpose of the invention relates to a lighting system comprising one set of at least 3 light sources with different spectra and intensities configured individually by a method like that defined above.

The light sources can be combined within a single bulb.

Therefore the invention makes it possible to control the light spectrum by judiciously combining different sources, in which the combination of the individual spectra can result in the required reference spectrum or its equivalent as seen by the observation system.

Other characteristics and advantages of the invention will become clear after reading the description of a preferred embodiment of the invention given as an example, with reference to the appended drawings.

DETAILED DESCRIPTION OF THE INVENTION

According to the invention, the lighting system to be configured comprises a set of at least 3 light sources with different spectra.

The invention does not relate to the determination of the set of three light sources, but aims to determine the best configuration starting from a given set of light sources, in other words the power or the intensity of each of the sources in the set.

The sources can be chosen specifically for a particular rendering, or quite simply whatever is available. The lighting system can use more light sources, and some may have identical or very similar spectra, but it is important that at least 3 of the sources have sufficiently different spectra so that better performances can be obtained.

It must be possible to control the light sources using a control device such that their intensity can be configured individually. As will be seen later, a good configuration of the intensities of each of the sources provides the means of making the lighting system approach a reference spectrum (or set values) with a minimum margin.

The lighting system can be implemented in different manners.

Figure 1:
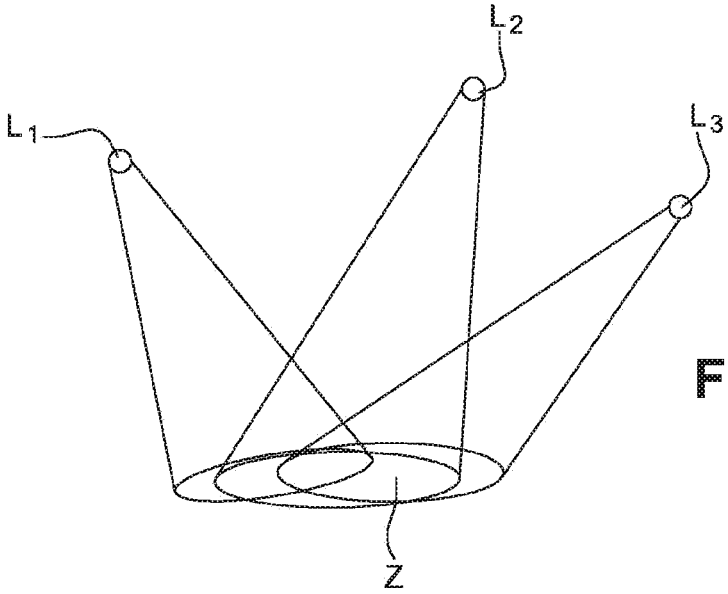
FIG. 1 diagrammatically represents an example of a lighting system according to one embodiment of the invention.

FIG. 1 illustrates a first embodiment that consists of arranging independent light sources L1, L2, L3, distributed in space (for example in a room) in which the beams are oriented so as to create an overlap zone Z within which the light spectrum is closest to the reference spectrum.

Figure 2:
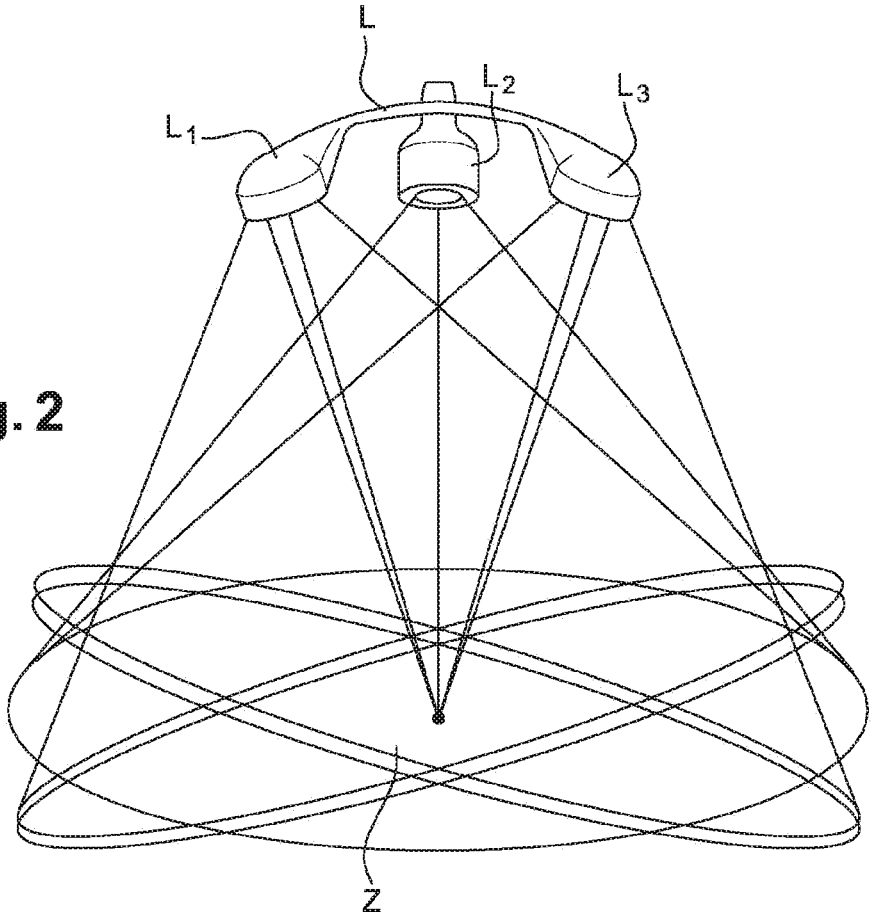
FIG. 2 diagrammatically represents another example of a lighting system according to another embodiment of the invention.

FIG. 2 illustrates a second embodiment in which the lighting system is composed of a rigid or non-rigid structure L that fixes the different light sources L1, L2, L3 relative to each other. The structure L orients the light beams of each source so as to create the largest possible overlap zone Z within which the light spectrum is closest to the reference spectrum.

In another embodiment, the light sources are combined inside a single bulb. The overlap zone of the different sources is then very large.

Different technologies can be used to implement the light sources. In particular, Light Emitting Diodes (LEDs) may be used.

Each light source $L_i$ can be characterised by an intensity $\varphi_i$ and a spectrum $S_i(\lambda)$, in which $\lambda$ represents the wavelength.

Thus, the synthetic spectrum $S_s(\lambda)$ of a lighting system composed of n light sources $L_1, L_2, L_3, \ldots L_i, \ldots L_n$, can be written as the sum of the spectra $S_i(\lambda)$ of each of these sources, weighted by their intensities $\varphi_i$. Therefore we can write:

$$S_s(\lambda) = \sum_{i=\lambda}^{n} \varphi_i \cdot S_i(\lambda)$$

The sensitivity curves $\sigma_j(\lambda)$ of the observer as a function of the wavelength $\lambda$ are also defined. The observer is typically composed of a set of detectors defining a set of channels. Thus, the human eye considered as an observer, has a set of groups j of detectors, each group having its own sensitivity curve $\sigma_j(\lambda)$.

This is particularly the case for digital sensors.

Thus, the perception $P_j$ on a channel j of an observer can be defined by:

$$P_j = \int_0^{\infty} S_s(\lambda) \cdot \sigma_j(\lambda) \cdot d\lambda$$

The invention aims to minimise a distance between a reference spectrum $S_R(\lambda)$ and the synthetic spectrum $S_S(\lambda)$. Minimising the distance $d(\lambda)=d(S_R(\lambda), S_S(\lambda))$ consists of determining the best combination of intensities $\varphi_i$, where $i \in [1,n]$ and n is the number of light sources.

According to one embodiment, the distance is a distance between the perception $P_{R,j}$ corresponding to the reference spectrum and the perception $P_j$ corresponding to the synthetic spectrum for a given observer.

$$P_{R,j} = \int_0^{\infty} S_R(\lambda) \cdot \sigma_j(\lambda) \cdot d\lambda$$

The distance may then be considered globally, in other words for all the channels j. The distance can be a Euclidean distance in the parameter space $\varphi_i$. In this case the problem consists of a search for the set of intensities, $\{\varphi_1, \varphi_2, \varphi_3 \ldots\}$.

In other words, the objective is to minimise a function $$\Delta(\varphi_1, \varphi_2, \varphi_3 \ldots) = \sqrt{(P_{R,j} - P_j)^2}$$

Different techniques can be used to solve such an optimisation problem and the invention does not depend on any particular method. For example, the least squares method can be used.

The reference spectrum can be the solar spectrum. The observer can be the human eye. In this case, the invention can maximise the CRI (colour rendering index).

Figure 3:
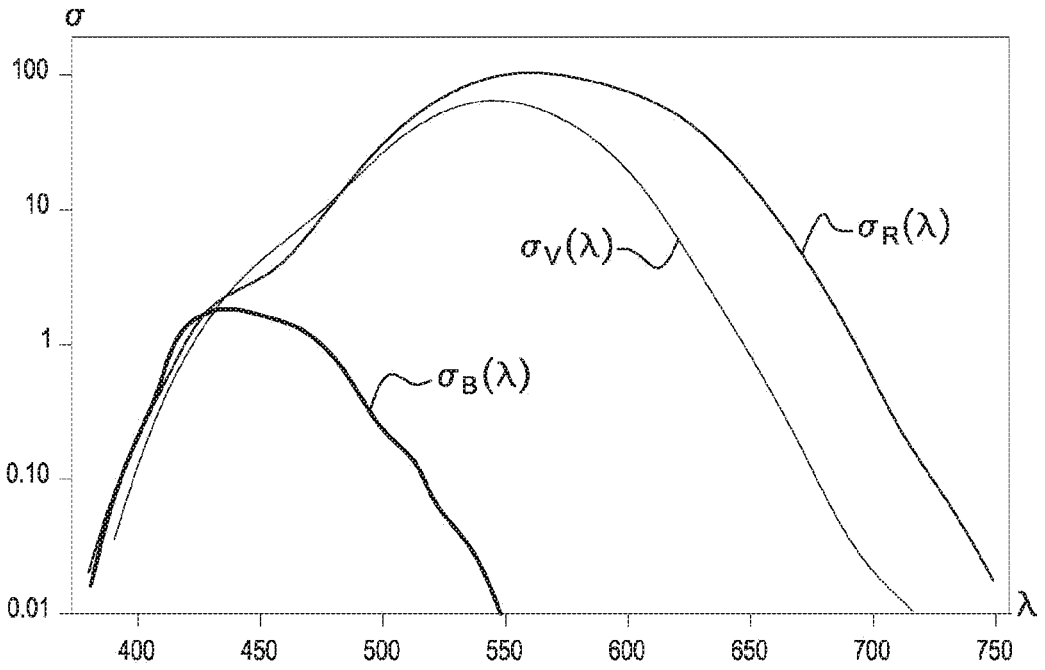
FIG. 3 diagrammatically represents the spectral sensitivity of three types of detectors, the cones in the human eye.

FIG. 3 shows the spectral sensitivity of the three types of detectors, the cones in the human eye, that gives the sensation of colour. These detectors correspond to three channels, R, V, B for the colours red, green and blue respectively, and are associated with three sensitivities $\sigma_R(\lambda)$, $\sigma_V(\lambda)$, $\sigma_B(\lambda)$ giving the three curves in the figure. The scale in the figure is logarithmic.

It can be noted that the spectral range of firstly red and green cones, and secondly blue cones, are very different. A difference in the spectral range of the blue cones has much less impact on the colour rendering. According to one embodiment of the invention, this information can thus be used to determine the global perception $P_s(\lambda)$.

Figure 4:
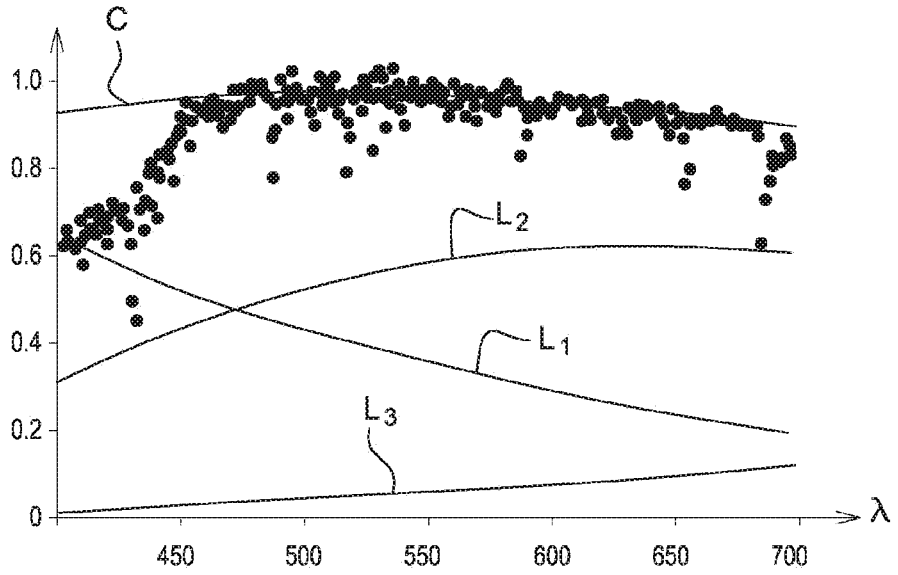
FIG. 4 diagrammatically represents the comparison between a reference spectrum and a synthetic spectrum of a lighting system configured according to one embodiment of the invention.

In the example illustrated in FIG. 4, three light sources, $L_1$, $L_2$, $L_3$ have been chosen with spectra characterised by colour temperatures of 10000K, 4500K and 3000K respectively.

The method according to the invention can be used to configure the system composed of these sources by determining the relative intensities.

The cloud of points represents measurements of the reference spectrum, for example the solar spectrum, and curve C represents the combination of light sources $L_1$, $L_2$, $L_3$ configured in intensity by the method according to the invention taking account of the sensitivity of the eye.

It can be seen that the characteristics of the human eye and particularly the lower sensitivity of the blue detectors have been taken into account, as seen in FIG. 3. Taking account of the sensitivity of detection channels is critical in the case in which the application aims to guarantee a good CRI.

The following table shows experimental results obtained according to one embodiment of the invention.

| Lamp | Lighting angle | CRI | Average lamp | Average total |
|---|---|---|---|---|
| A | 0 | 96.87 | 96.91 | 96.70 |
| | 20 | 96.91 | | |
| | 40 | 96.94 | | |

-continued

| Lamp | Lighting angle | CRI | Average lamp | Average total |
|---|---|---|---|---|
| B | 0 | 96.83 | 96.85 | |
| | 20 | 96.87 | | |
| | 40 | 96.85 | | |
| C | 0 | 96.65 | 96.72 | |
| | 20 | 96.69 | | |
| | 40 | 96.83 | | |
| D | 0 | 95.98 | 96.33 | |
| | 20 | 96.36 | | |
| | 40 | 96.64 | | |

These results show that the results remain stable even at an angle of 40° from the axis of the system.

The average CRI for these 4 test lighting systems is 96.70, which is an excellent result compared with solutions known in the state of the art.

Furthermore, unlike a "white" LED according to the state of the art that combines 3 coloured LEDs in a single LED, the lighting system according to the invention combines several sources for which the angular opening can be adjusted individually. Thus, the spatial overlap of fields illuminated by each of the light sources can be optimised (although a compromise is necessary for white LEDs known in the state of the art).

The method according to the invention can this deterministically defined by the best combination of elementary light sources to simulate a rendering equivalent to that of a reference spectrum. The principle was validated in theory using three sources defined according to Planck's law for optimisation of the CRI. Transposed to the case of LEDs, measurement of a CRI larger than 96 demonstrates the relevance of the approach. Obviously, the principal validated herein with 3 LEDs can be generalised to a larger number of light sources.

Obviously, this invention is not limited to the examples and the embodiment described and represented herein, but many variants accessible to those skilled in the art can be adopted.

The invention claimed is:

1. Method of configuring a lighting system comprising a set of at least 3 light sources ($L_i$) with different spectra ($S_i(\lambda)$), including a step of automatically determining the intensities ($\varphi_i$) of each of the light sources of said set by minimising a distance between a reference spectrum ($S_R(\lambda)$) and a synthetic spectrum ($S_S(\lambda)$) determined by the sum of the spectra ($S_i(\lambda)$) of each source ($L_i$) of said set weighted by said intensities ($\varphi_i$) in which said distance is calculated between a perception ($P_{R,j}(\lambda)$) corresponding to said reference spectrum and a perception ($P_j(\lambda)$) corresponding to said synthetic spectrum, said perceptions being considered on a set of detectors (j) of a given observer.

2. Configuration method according to claim 1, in which said reference spectrum is the solar spectrum.

3. Configuration method according to claim 1, in which said given observer is a human eye.

4. Configuration method according to claim 1, in which said perceptions are determined by the product of said spectra and sensitivities ($\sigma_j(\lambda)$) associated with each of said detectors.

5. Configuration method according to claim 4, in which said perception of the synthetic spectrum is provided by the equation:

$$P_j = \int_0^\infty S_s(\lambda) \cdot \sigma_j(\lambda) \cdot d\lambda$$

and perception of the reference spectrum is provided by the equation:

$$P_{R,j} = \int_0^\infty S_R(\lambda) \cdot \sigma_j(\lambda) \cdot d\lambda$$

and in which $\lambda$ represents the wavelength.

6. Configuration method according to claim 1, in which said distance is minimised by a least squares method.

7. Configuration method according to claim 1, in which said light sources are LEDs.

* * * * *